US005413395A

United States Patent [19]

Stewart

[11] Patent Number: 5,413,395

[45] Date of Patent: May 9, 1995

[54] CARRIER FOR BOTTLES AND LIKE CONTAINERS

[75] Inventor: Maurice W. Stewart, Birmingham, England

[73] Assignee: International Omni-Pak Corporation, Palm Beach, Fla.

[21] Appl. No.: 223,580

[22] Filed: Apr. 6, 1994

[30] Foreign Application Priority Data

Apr. 8, 1993 [GB] United Kingdom ..... 9307372

[51] Int. Cl.[6] ..... B65D 71/00

[52] U.S. Cl. ..... 294/87.2; 206/151; 206/158; 206/161

[58] Field of Search ..... 294/87.2, 87.28, 159; 206/145, 147, 148, 150, 151, 158, 159, 161, 199, 201, 427

[56] References Cited

U.S. PATENT DOCUMENTS

| | | | |
|---|---|---|---|
| 3,387,879 | 6/1968 | Wood | 294/87.2 |
| 3,871,699 | 3/1975 | Hatfield | 294/87.2 |
| 3,912,075 | 10/1975 | Berry | 206/158 |
| 4,090,729 | 5/1978 | Erickson | 294/31.2 |
| 4,093,295 | 6/1978 | Erickson | 294/87.2 |
| 4,235,468 | 11/1980 | Erickson | 294/87.2 |
| 4,247,142 | 1/1981 | Erickson | 294/87.2 |
| 4,249,766 | 10/1981 | Erickson | 294/87.2 |
| 4,372,598 | 2/1983 | Quelch | 294/87.2 |
| 4,471,987 | 9/1984 | Erickson | 294/87.2 |
| 4,634,002 | 1/1987 | Delonghi | 294/87.2 X |
| 5,188,413 | 2/1993 | Nathan | 294/87.2 |
| 5,199,562 | 4/1993 | Adami et al. | 294/87.2 X |

FOREIGN PATENT DOCUMENTS

| | | | |
|---|---|---|---|
| 478697 | 11/1969 | Switzerland | 294/87.2 |

*Primary Examiner*—Johnny D. Cherry
*Attorney, Agent, or Firm*—Brumbaugh, Graves, Donohue & Raymond

[57] ABSTRACT

A carrier for a plurality of bottles or like containers having a plurality of collars in an integral frame for securing the necks of the bottles and a skirt depending from each collar to engage each bottle to restrain relative movement between the bottle and the carrier.

4 Claims, 1 Drawing Sheet

CARRIER FOR BOTTLES AND LIKE CONTAINERS

BACKGROUND OF THE INVENTION

This invention relates to carriers for bottles and like containers having a neck and an associated circumferential projection and which carriers are of the type used to attach two or more such containers releasably together at their necks as a pack for ease of storage, transportation and display for sale, the carriers co-operating with the circumferential projections to retain the containers to the carriers.

Carriers of this type may be expected to fulfil a variety of requirements. As well as attaching a desired number of containers together as a pack, they will usually need to have sufficient strength to enable the pack of containers to be carried by the carrier, retain the containers in spaced apart relationship and contribute to the stability of the pack when stored or transported. It is desirable for the carriers to be attached effectively to the containers so that the containers cannot easily be detached unintentionally from the carriers and yet can be released from the carrier when required without undue difficulty. The carrier should also be sufficiently cheap to produce so as not to add significantly to the cost of the product being packaged.

SUMMARY OF THE INVENTION

The object of the present invention is to provide a carrier which satisfies these requirements.

According to the present invention a carrier is provided of the kind described adapted for attachment to a plurality of bottles or like containers having a neck and associated circumferential projection, and which comprises a structural frame supporting a plurality of collars each adapted to receive the neck of a container and engage with the associated circumferential projection to retain the container to the carrier, and each having a resilient skirt which depends from the collar and is adapted to co-operate with a part of the exterior surface of a container below the circumferential projection when the neck of such a container is received in the collar, thereby to act in conjunction with the collar to restrain relative movement between the container and the carrier.

Where there are three or more of the collars they may be aligned in a single row, in more than one row or in any other convenient disposition. Preferably, the collars are spaced apart sufficiently for the containers to which the carrier is attached for use to be retained in a spaced apart relationship by the structural frame.

Each resilient skirt may extend fully around its respective collar; it may extend only partially around the collar or it may be divided into segments spaced around the collar. The collar and skirt act together on a container which has its neck received in the collar so as to restrain the container from axial and lateral movement relative to the collar and skirt, and hence movement relative to the frame. Consequently, the carrier increases the stability of a pack of containers attached to the carrier when stored or carried.

The carrier may be formed from an integral one piece injection moulding of a suitable plastics material.

The structural frame may be provided as a framework or as a plate. When provided as a plate, the structural frame may be suitably reinforced to increase its mechanical resistance; apertures may also be provided and may serve to reduce the amount of material used to form the frame and/or may provide carrying holes to facilitate lifting and carrying of the carrier.

Each collar may be provided as a continuous resilient annulus having an inner edge defining an aperture to receive the neck of a container and which can resiliently expand to allow the associated circumferential projection to pass through for the collar to engage under the projection. Preferably, each collar comprises a plurality of annularly spaced resilient tabs having inner edges which together define an aperture to receive the neck of a container and which also can resiliently expand to allow the circumferential projection to pass through. When the neck of a container is inserted into the aperture of a collar, the annulus or tabs is or are deflected resiliently outwards to allow the associated circumferential projection to pass through the aperture. The annulus or tabs subsequently resume the original position and co-operate with the underside of the circumferential projection to resist withdrawal of the neck from the aperture. The annulus or each tab of each collar may be inclined upwardly towards its inner edge, away from the skirt, giving the collar a generally frustoconical form; such an inclination enhances the mechanical performance of the annulus or tabs in resisting release of the collar from the circumferential projection with which it is engaged.

Preferably, each skirt comprises four equiangularly spaced segments. When the neck of a container is inserted into the respective collar, the associated circumferential projection passes through the collar. A widening part of the container below the circumferential projection may engage the inside of the respective skirt, forcing the skirt to expand resiliently radially outwards such that the skirt grips the container.

DESCRIPTION OF DRAWINGS

An embodiment of the invention will now be described, by way of example only, with reference to the accompanying drawing in which.

DESCRIPTION OF PREFERRED EMBODIMENTS

Figure 1:
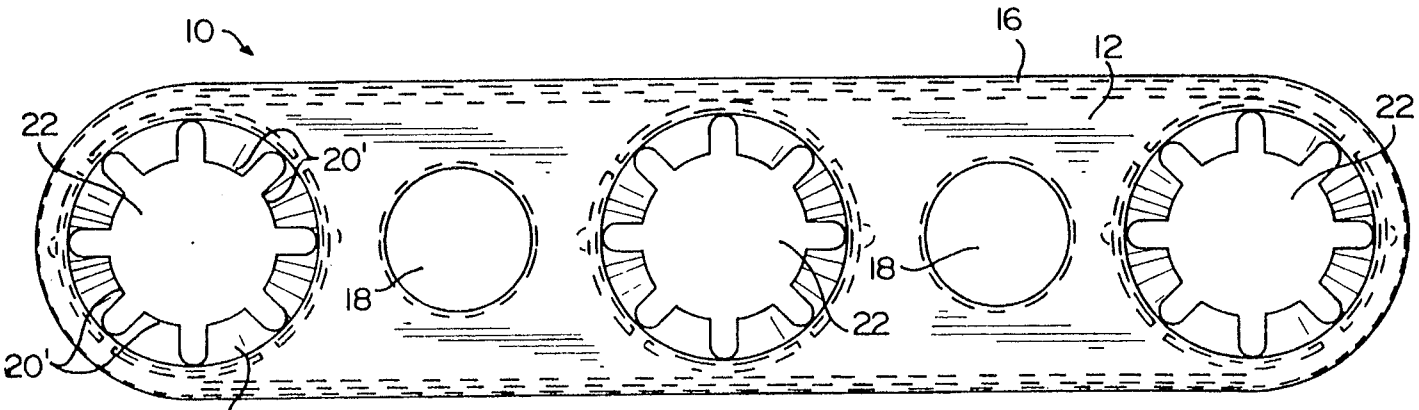
FIG. 1 shows a plan view of a carrier in accordance with the present invention.

The carrier 10 shown in the drawings is intended for attachment to bottles, more particularly three bottles, to connect them together as a pack. It is made from a unitary plastics moulding and comprises a structural frame 12 in the form of a plate supporting three linearly aligned collars 14.

The structural frame 12 has a reinforcing rim 16 around its entire perimeter. Two apertures 18 are provided in the structural frame, one on either side of the central collar 14. These apertures 18 serve as carrying holes to facilitate lifting and carrying of a pack of bottles connected by the carrier 10 and also reduce the amount of plastics material required to mould the carrier 10.

Figure 2:
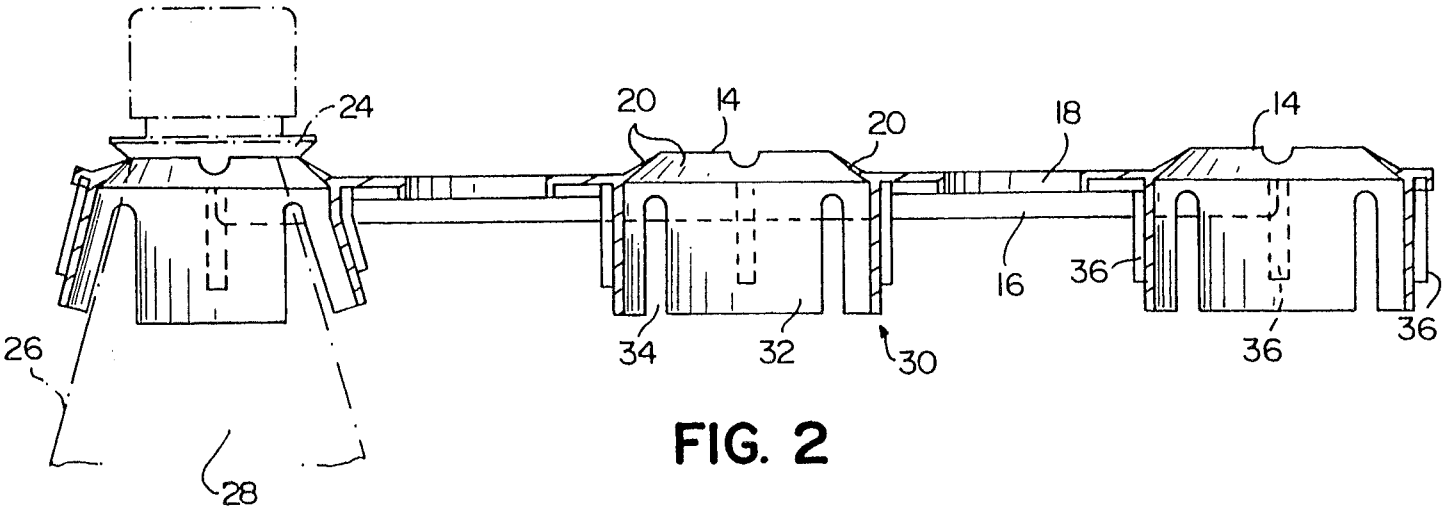
FIG. 2 shows a longitudinal cross section of the carrier of FIG. 1 with the top of a bottle shown in phantom engaged in one of the collars of the carrier.

Each collar 14 comprises eight resilient tabs 20, equiangularly spaced, disposed in a circle, being joined at their roots to the structural frame 12 and extending inwardly to define an aperture 22 at inner edges 20'. As can most clearly be seen from FIG. 2, each tab 20 rises at an angle from the structural frame towards the aperture 22 so that each collar has a frusto-conical shape. The tabs 20 are adapted to co-operate with the underside of a bead or shoulder 24 at the upper end of a neck 26 of a bottle 28. Depending from each collar 14 is a skirt 30 which comprises four equi-angularly spaced segments 32 separated by slots 34. Each skirt 30 is cylindrical but is able to flare resiliently outwards, downwardly, so that it can grip the downwardly widening outside surface of the neck of the bottle 28 engaged in the respective collar.

The carrier is attached to bottles simply by pushing the collars 14 over the tops of the respective bottles until the tabs 20 of the collars engage with the undersides of the beads or shoulders 24 of the necks 26 of the bottles. The engagement resists withdrawal of the bottles from the carrier although a bottle can be pulled out of the collar when separation is required. The grip of the skirts of the necks of the bottles below the beads or shoulders 24 restrains the bottles from movement relative to the carrier laterally and axially of the collars.

I claim:

1. An integrally molded carrier for a plurality of bottles or like containers having a neck and upper circumferential projection, comprising a structural frame supporting a plurality of collars, each for receiving the neck of a bottle and engaging with the circumferential projection to retain the bottle to the carrier, a plurality of segments spaced apart by slots and depending from each collar for cooperating with a part of the exterior surface of a neck of a bottle below the circumferential projection when the neck is received in the collar, the segments being integrally formed with the frame at their upper ends and being deflectable outwardly for expansion at their lower ends, thereby to act in conjunction with the collar to restrain relative movement between the container and the carrier.

2. A carrier as set forth in claim 1, including at least three collars aligned in a single row.

3. A carrier as set forth in claim 1, in which the integrally molded carrier is an integral one-piece injection molded plastics material.

4. A carrier as set forth in claim 1 in which each collar includes a plurality of annularly spaced tabs inclined upwardly from the frame and away from the depending segments.

* * * * *